US005102148A

United States Patent [19]

Mizunuma

[11] Patent Number: 5,102,148

[45] Date of Patent: Apr. 7, 1992

[54] PICK-UP GAME

[75] Inventor: Masanori Mizunuma, Tateishi, Japan

[73] Assignee: Tomy Company, Ltd., Tokyo, Japan

[21] Appl. No.: 557,068

[22] Filed: Jul. 25, 1990

[30] Foreign Application Priority Data

Aug. 9, 1989 [JP] Japan ..... 1-93734[U]

[51] Int. Cl.[5] ..... A63F 9/00

[52] U.S. Cl. ..... 273/447

[58] Field of Search ..... 273/1 GG, 1 GC, 140, 273/367, 368, 447; 446/332

[56] References Cited

U.S. PATENT DOCUMENTS

| | | | |
|---|---|---|---|
| 1,169,257 | 1/1916 | Heep | 273/367 |
| 1,473,603 | 11/1923 | Anderson | 273/140 |
| 3,788,641 | 1/1974 | Lemelson | 273/140 X |
| 4,183,172 | 1/1980 | Lewis et al. | 246/332 |
| 4,214,750 | 7/1980 | Shimizu | 273/140 X |
| 4,224,761 | 9/1980 | Wakimura | 273/237 |
| 4,603,860 | 8/1986 | Wey | 273/140 X |

FOREIGN PATENT DOCUMENTS

| | | | |
|---|---|---|---|
| 346424 | 2/1937 | Italy | 446/332 |

*Primary Examiner*—Paul E. Shapiro
*Attorney, Agent, or Firm*—Staas & Halsey

[57] ABSTRACT

A pick-up game includes a base portion, a shell rotatably mounted on the base portion, a plurality of pintles mounted for reciprocating and rotating movement of the shell, and a motor for rotating the shell and thus orbiting the pintles around a rotation axis of the shell. Rack and cam segments coupled to the base portion reciprocate and rotate the pintles and pick-up figures carried by the plurality of pintles.

16 Claims, 4 Drawing Sheets

PICK-UP GAME

BACKGROUND OF THE INVENTION

1. Field of the Invention

The present invention relates generally to amusement devices and, more specifically, to a pick-up game in which the objects to be picked up undergo compound movement to increase the level of difficulty of the game.

2. Description of the Related Art

There are presently known fishing games in which a fish is picked up by placing a bait in the mouth of the fish when it is in an open position. When the mouth closes, the bait and fish are coupled so that the fish can be picked up.

This type of game is relatively simple and can be played by only one player at a time. Thus, the game is one which can become easily tiresome, due principally to the low level of difficulty of the game.

SUMMARY OF THE INVENTION

An object of the present invention is to provide a pick-up game in which objects to be picked up undergo compound movement, thereby rendering same more difficult to pick up.

Another object of the present invention is to provide a pick-up game which can be played by two or more players simultaneously, thus enhancing the interest and competitiveness of the game.

Another object of the present invention is to provide a pick-up game which is relatively simple in construction and cost effective to produce.

These and other objects of the invention are met by providing a pick-up game which includes a base, a shell rotatably mounted on the base, a plurality of pintles mounted for reciprocating movement on the shell, drive means for rotating the shell, means coupled to the base for reciprocating and rotating the pintles, and a plurality of pick-up figures, each carried by a corresponding one of the pintles.

Preferably, pick-up hooks are provided for each player. The pick-up figures are shaped to resemble monsters and have an opening formed at the bottom thereof and a pair of elastic arms capable of being grasped by the pick-up hooks.

These and other features and advantages of the pick-up game according to the present invention will become more apparent with reference to the following detailed description and drawings.

DETAILED DESCRIPTION OF THE PREFERRED EMBODIMENTS

Figure 1:
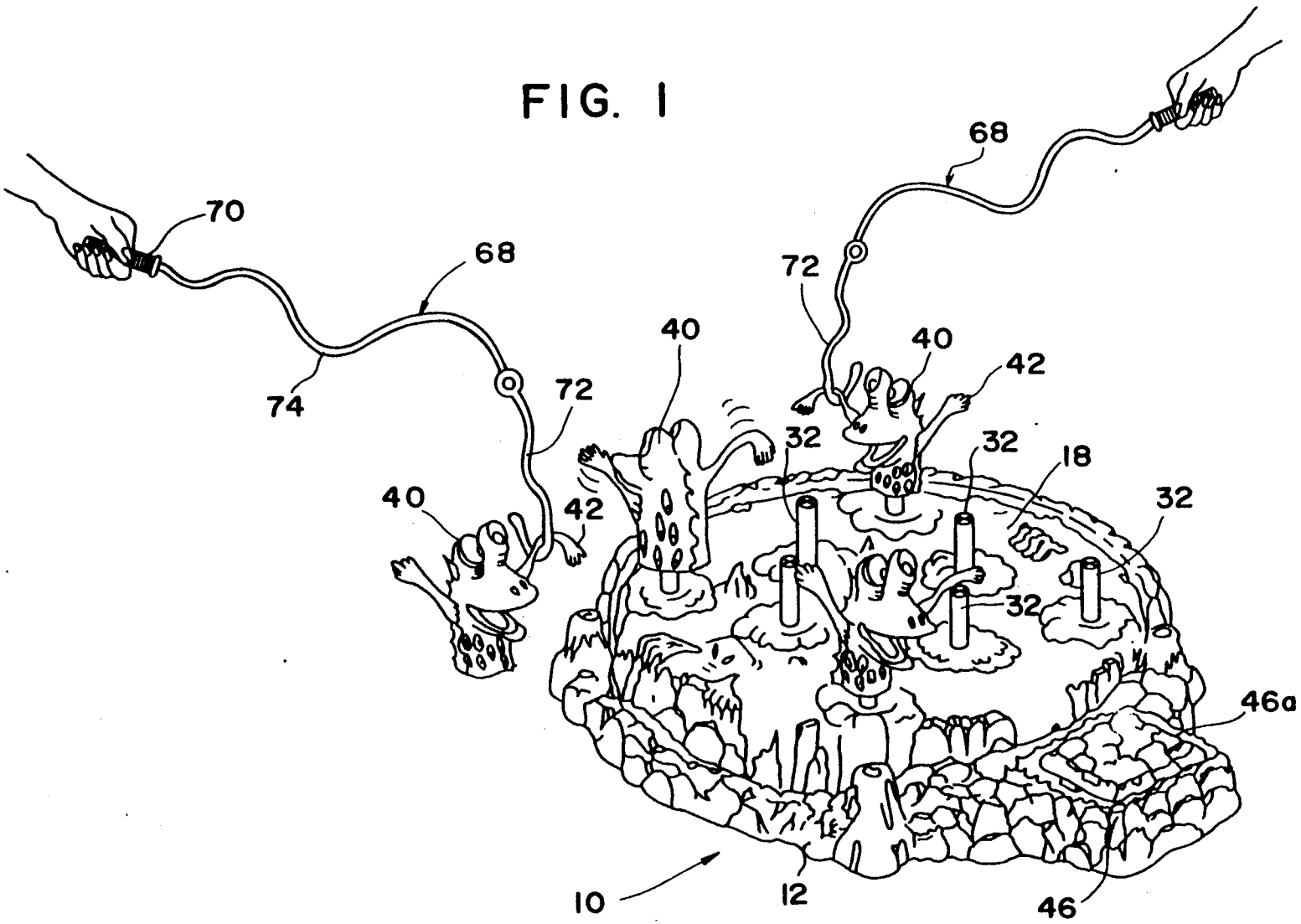
FIG. 1 is a perspective view of a preferred embodiment of the present invention.
Figure 3:
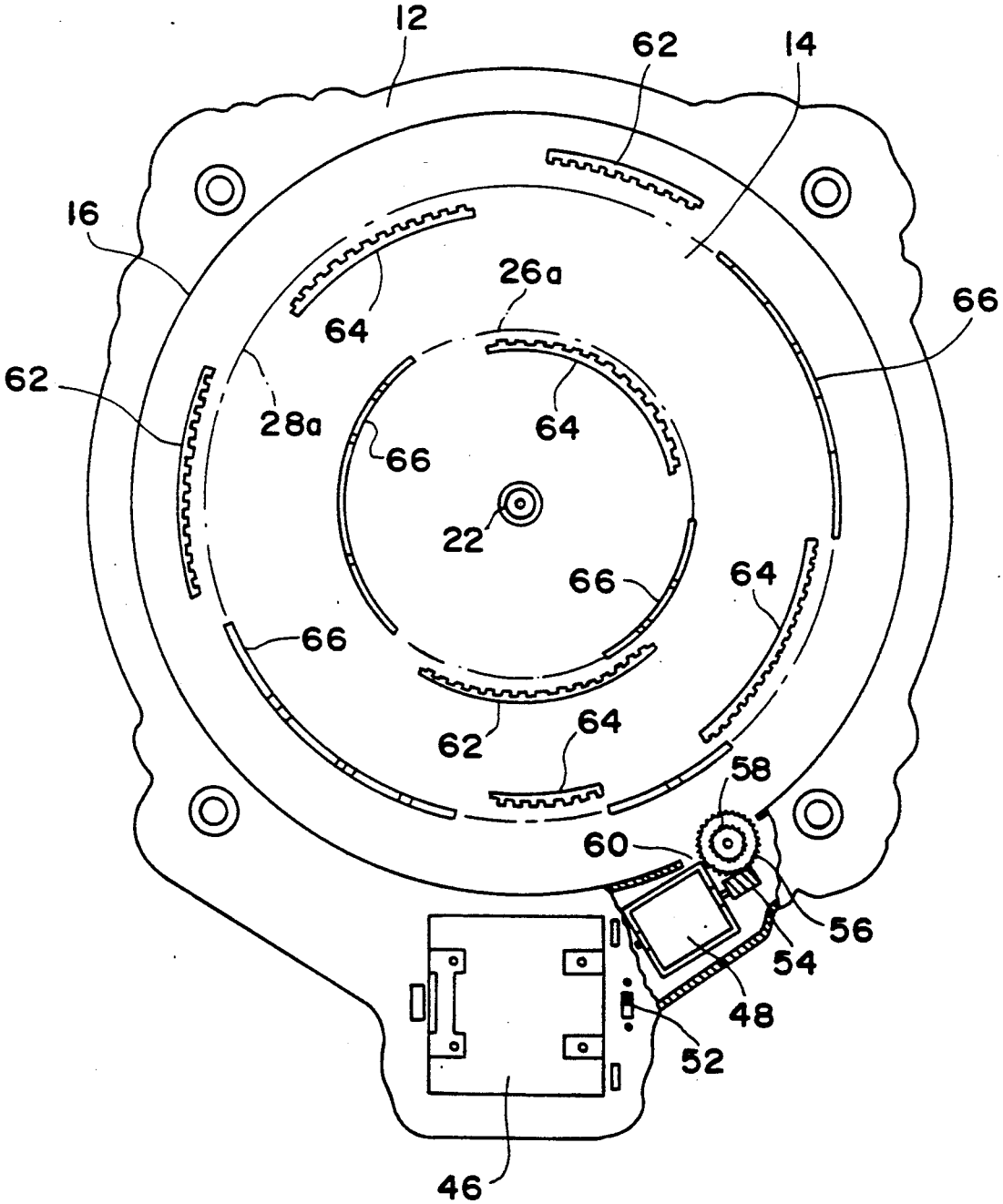
FIG. 3 is a top view of a base portion of the FIG. 1 embodiment.

Referring now to FIG. 1, a pick-up game according to the present invention is generally referred to by the numeral 10 and includes a base portion 12 which has a generally circular shape with an annular rim which circumscribes a flat circular bottom. The circular bottom, designated by the numeral 14 in FIG. 3, is recessed from the rim portion 16.

Figure 5:
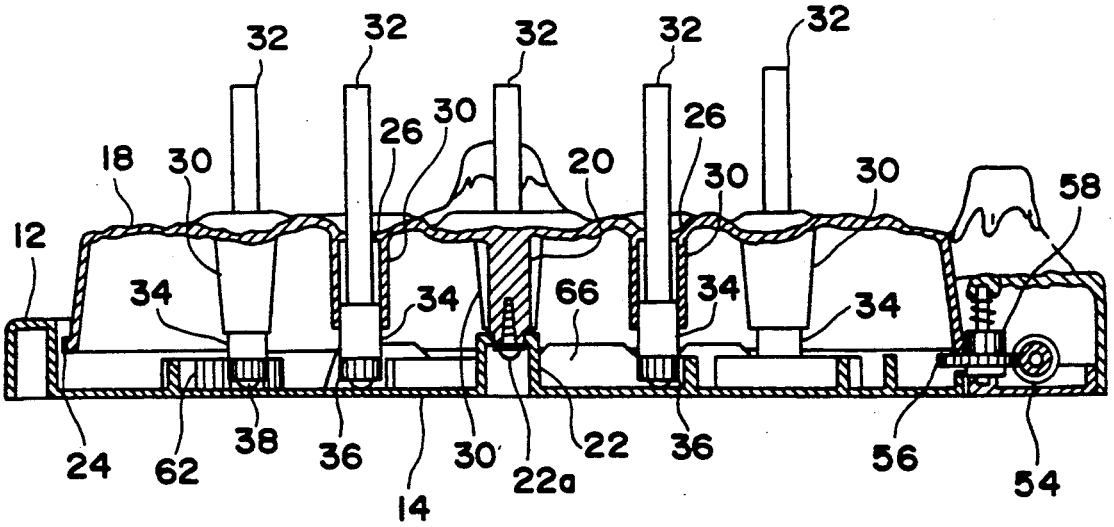
FIG. 5 is a side elevational view, partly in section, showing the pick-up game of FIG. 1.

A shell 18 is rotatably mounted on the base portion 12 and is driven rotatably in the circular bottom 14. The rotatable mount is illustrated in FIG. 5, wherein a mounting post 20 integrally formed with the shell 18 is rotatably mounted on a central projection 22 of the base portion 12, and secured thereto by a bolt 22*a*.

The shell 18 has a generally disk-shape with a circular lower peripheral edge 24 which is provided with gear teeth which mesh with a drive pinion (to be described later).

Figure 2:
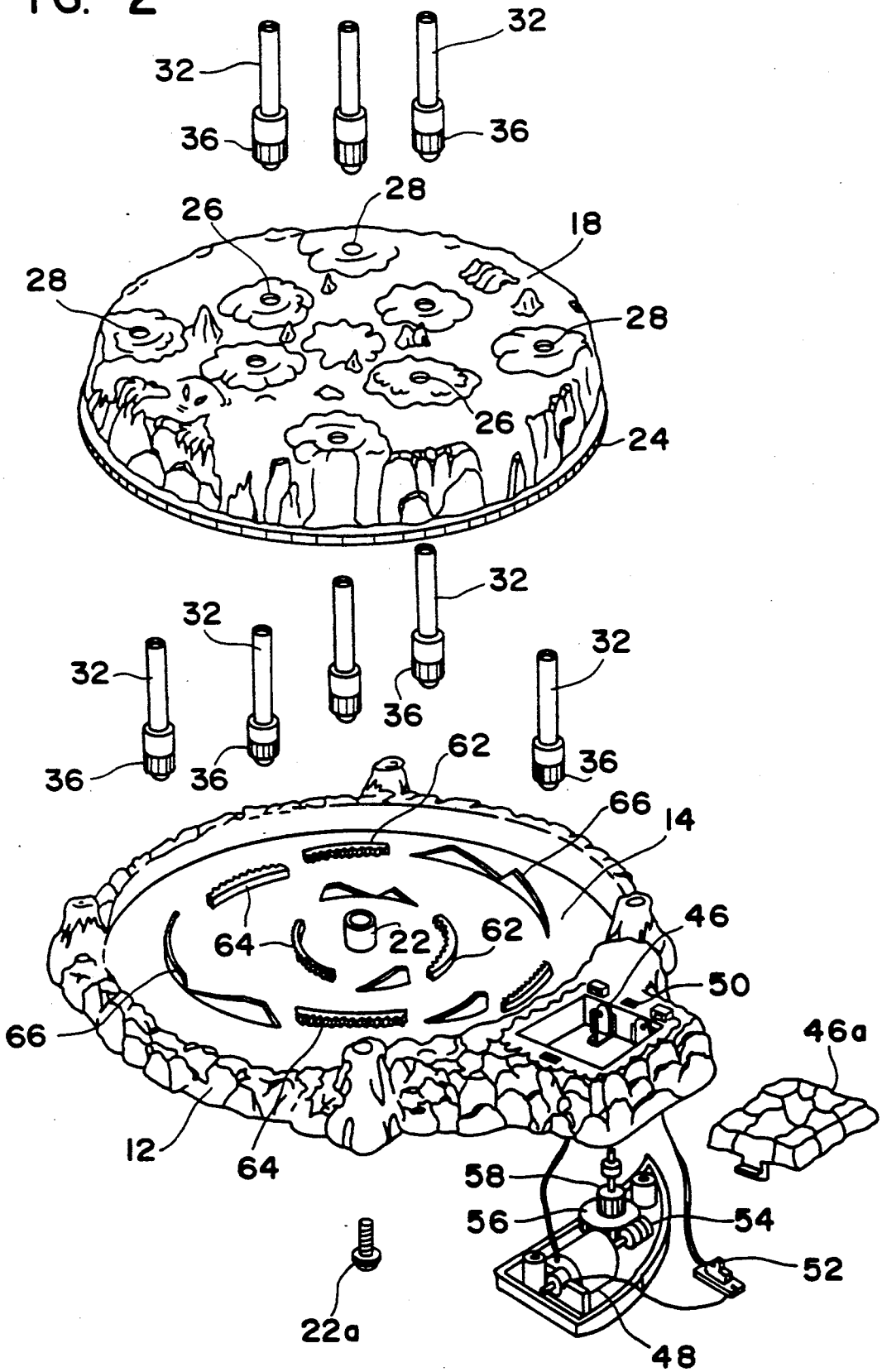
FIG. 2 is an exploded perspective view of the embodiment of FIG. 1.

Two sets of holes 26 and 28 (see FIG. 2) are formed respectively on two different radii from the rotation axis of the disk 18. The set of holes 26 are formed on a first radius, meaning that the center of the holes lie on the same radius from the rotation axis of the shell 18, while the set of holes 28 lie on a second, larger radius. Each radius defines an orbital path for each set of pintles for orbiting around the rotational axis of the shell. In the illustrated embodiment, there are four holes in each set, with the four holes of each set being equally spaced around the rotation axis of the disk 18. Since there are four holes, the holes are spaced at 90° intervals. Moreover, the two sets of holes are staggered so that one of the holes 26 lies on a vector which falls between two of the holes 28. This provides an even spacing of the holes across the upper surface of the disk 18.

Each of the holes 26 and 28 opens into a cylindrical support 30 which is integrally formed with the shell 18 and extends downwardly towards the circular bottom 14 of the base portion 12. A plurality of pintles 32 are mounted for reciprocating movement on the shell 18. An enlarged cylindrical portion 34 of the pintles 32 is loosely slidable in corresponding cylindrical supports 30. A pinion gear 36 is formed on the periphery of the cylindrical portion 34 and a spherical tip 38 is provided on the end of the cylindrical portion 34 so as to slidably engage the circular bottom 14 of the base portion 12. The upper portion of each pintle 32 has a reduced diameter and extends upwardly from the surface of the shell 18. A plurality of pick-up FIGS. 40 (see FIG. 4) are carried respectively by the upstanding pintles 32. Each FIG. 40 has a pair of arms 42 which are capable of being hooked by pick-up hooks manipulated by players of the game so as to remove the FIGS. 40 from their corresponding pintles 32. Each FIG. 40 has a central cavity 44 which has an opening at the bottom of the FIG. 40 for receiving a distal end of the pintle 32.

A battery compartment 46 stores a battery power source which powers an electric motor 48. A cover 46*a* is releasably attached to the base portion 12 over the battery compartment 46. An opening 50 is provided in the base portion 12 near the battery compartment 46 providing access for a power on/off switch 52. When the motor 48 is switched on by the switch 52, a worm gear 54 coupled to the output shaft of the motor 48 rotates gear 56 which is coaxially mounted with a pinion 58. The pinion 58 protrudes through an opening 60 (see FIG. 3) provided in the base portion 12. The pinion 58 meshes with the peripheral edge 24 of the shell 18 to impart rotational movement in the shell 18.

As the shell 18 rotates, the centers of the first set of holes 26 travel over a first radius 26*a* illustrated in FIG.

3, while the centers of the second set of holes 28 travels over a second radius 28*a*.

Referring to FIG. 3, each radius 26*a* and 28*a* is provided on opposite sides thereof with arcuate rack segments 62 and 64, each rack segment having teeth which oppose the corresponding radius. Each rack segment 62 and 64 extends upwardly from the bottom 14 of the base portion 12 and is preferably integrally formed with the base portion. The rack segments are preferably of varying length and are disposed asymmetrically around the rotational axis of the shell 18. As a result, the pinion 36 of each pintle 32 meshes intermittently with the rack segment 62 and 64 so as to be rotated in a clockwise direction and a counterclockwise direction. The pintles are thus rotatable in two opposite directions, while simultaneously orbiting around the rotational axis of the shell 18. Since the pick-up FIGS. 40 are carried by the pintles, they too orbit and rotate in opposite directions. While the orbiting motion is carried out so long as the motor 48 is energized, the clockwise and counterclockwise rotation of each pintle and FIG. 40 carried thereon occurs intermittently whenever the pinion 36 meshes with an arcuate rack segment 62 or 64.

Figure 4:
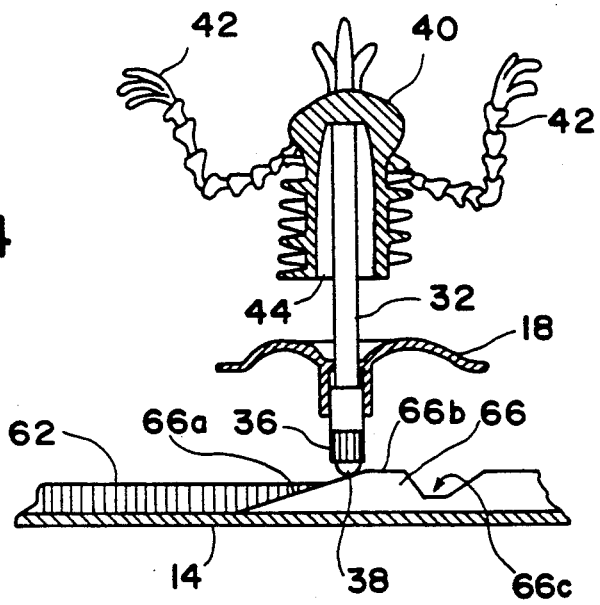
FIG. 4 is a partial sectional view showing one of the pick-up figures and its corresponding pintle.

Arcuate camming segments 66 are formed on the two radii 26*a* and 28*a* at irregular intervals and of varying length at positions which preferably do not overlap with the positions of the arcuate rack segments 62 and 64. Thus, when the pintles 32 are not rotating due to the rack segments 62 and 64, they are caused to reciprocate by sliding along an upwardly projecting surface of the camming segments 66. For example, as illustrated in FIG. 4, the tip 38 of the pintle 32 slides along the sloping surface 66*a* of the camming segment 66, thus causing the pintle 32 to move upwardly. After advancing over the flat surface 66*b*, the pintle falls downwardly into a notch 66*c* formed in the camming segment 66, whereupon the tip 38 is forced over another sloping surface so as to once again move upwardly. The effect is to cause the pintle to reciprocate when the pinion 36 is disengaged from the rack segments 62 and 64. It is possible, however, to overlap the arcuate rack segments 62 and 64 with a camming segment 66, so that while the pintle 32 is on the sloping surface 66*a* the pintle can be rotated by the pinion 36 until the pinion becomes separated from the teeth of the rack 62 or 64. Thus, the pintle is capable of rotating during at least a portion of its reciprocating movement, so that rotating and reciprocating movement are not necessarily mutually exclusive.

The game includes, as shown in FIG. 1, pick-up hooks 68 which have handles 70 and hooked end portions 72, with the hooked end portions 72 being pivotally connected to a main shaft portion 74 at a swivel joint. The object of the game is to pick up the FIGS. 40 with the pick-up hooks 68 by hooking the arms 42 of the FIGS. 40. The arms are integrally formed with the body of the figures, which are molded of soft vinyl chloride base resin so that the arms are flexible and resilient. Also, the surfaces of the figures have great frictional resistance so that they can be easily adhered to synthetic resins, etc.

Preferably, the FIGS. 40 are shaped to resemble monsters with open mouths which can be hooked by the pick-up hooks, so that the player has the option of hooking the mouth or the arms of the FIG. 40.

The compound movement of the FIGS. 40 due to the reciprocation, rotation and orbiting movement of the pintles 32 makes it difficult for the player to pick up the FIGS. 40 with the pick-up hooks 68. This difficulty adds to the enjoyment of the game, which can be played in various modes. For example, a single FIG. 40 can be placed on one of the pintles 32, and multiple players can use the pick-up hooks 68 simultaneously to attempt to be the first to pick up the single FIG. 40. Other variations of the game can be envisioned easily, and all are included within the scope of the present invention.

Numerous modifications and adaptations of the present invention will be apparent to those so skilled in the art and thus, it is intended by the following claims to cover all such modifications and adaptations which fall within the true spirit and scope of the invention.

What is claimed is:

1. A pick-up game comprising:

a base portion;

a shell rotatably mounted on the base portion;

a plurality of pintles mounted for reciprocating and rotating movement on the shell;

drive means for rotating the shell and thus orbiting the pintles around a rotational axis of the shell;

means coupled to the base portion for reciprocating and rotating the pintles;

at least one pick-up figure carried by any one of the plurality of pintles;

at least one pick-up hook; and wherein each pick-up hook includes a pivotal end portion for hooking the at least one pick-up figure.

2. A pick-up game according to claim 1, wherein the drive means includes an electric motor and a transmission coupled between the electric motor and the shell.

3. A pick-up game according to claim 2, wherein a lower peripheral edge of the shell is circular and is provided with gear teeth which engage a drive gear of the transmission.

4. A pick-up game according to claim 1, wherein the plurality of pintles are mounted in two sets of holes provided in the shell, each set of holes disposed on a common radius from the rotational axis of the shell, with one radius for one set of holes being smaller than another radius for the other set of holes.

5. A pick-up game according to claim 4, wherein each of the holes of the two sets of holes has a corresponding cylinder formed therewith and extending downwardly towards the base portion.

6. A pick-up game according to claim 5, wherein each of the plurality of pintles is mounted in one of the cylinders of the holes, and each pintle has a proximal end which rests on a flat bottom of the base portion and a distal end which protrudes outwardly beyond an upper, outer surface of the shell.

7. A pick-up game according to claim 6, wherein each pintle is provided with a pinion at the proximal end, and the reciprocating and rotating means includes a plurality of arcuate rack segments disposed on opposite sides of the two radii of the two sets of holes and being engageable with the pinions of the plurality of pintles to thereby impart clockwise and counterclockwise rotation in the pintles.

8. A pick-up game according to claim 7, wherein the reciprocating and rotating means includes a plurality of arcuate camming segments disposed on each of the radii of the two sets of holes and being slidably engageable with the distal ends of the plurality of pintles to impart reciprocating movement in the pintles.

9. A pick-up game according to claim 8, wherein the camming segments and the rack segments are of varying length so as to render the reciprocating and rotating movement of the pintles irregular.

10. A pick-up game according to claim 1, wherein the reciprocating and rotating means comprises a plurality of arcuate rack segments formed on the base portion and being intermittently engageable with the plurality of pintles for imparting clockwise and counterclockwise rotational movement in the pintles.

11. A pick-up game according to claim 1, wherein the reciprocating and rotating means includes a plurality of camming segments disposed on the base under the plurality of pintles and being intermittently engageable with a distal end of the plurality of pintles to impart reciprocating movement in the plurality of pintles.

12. A pick-up game according to claim 11, wherein the plurality of pintles each have an orbiting path around a rotational axis of the shell, and the plurality of arcuate rack segments are disposed on opposite sides of each orbital path so that gear teeth of each rack segment faces the orbital path.

13. A pick-up game according to claim 1, wherein the at least one pick-up figure includes a plurality of pick-up figures, each being carried by a corresponding one of the plurality of pintles.

14. A pick-up game according to claim 13, wherein each pick-up figure includes a hollow body and a bottom opening for receiving each corresponding pintle in the hollow body.

15. A pick-up game according to claim 14, wherein each of the pick-up figures further includes at least one arm capable of being hooked by a pick-up hook.

16. A pick-up game comprising:

a base portion;

a shell rotatably mounted on the base portion;

a plurality of pintles mounted for reciprocating and rotating movement on the shell;

drive means for rotating the shell and thus orbiting the pintles around a rotational axis of the shell;

means coupled to the base portion for reciprocating and rotating the pintles; and at least one pick-up figure carried by any one of the plurality of pintles;

wherein the plurality of pintles are mounted in two sets of holes provided in the shell, each set of holes disposed on a common radius from the rotational axis of the shell, with one radius for one set of holes being smaller than another radius for the other set of holes;

wherein each of the holes of the two sets of holes has a corresponding cylinder formed therewith and extending downwardly towards the base portion; and wherein each of the plurality of pintles is mounted in one of the cylinders of the holes, and each pintle has a proximal end which rests on a flat bottom of the base portion and a distal end which protrudes outwardly beyond an upper, outer surface of the shell.

* * * * *